US009550097B1

(12) United States Patent
Myers et al.

(10) Patent No.: US 9,550,097 B1
(45) Date of Patent: Jan. 24, 2017

(54) GOLF CLUB HEAD WITH CAM WEIGHT

(71) Applicant: CALLAWAY GOLF COMPANY, Carlsbad, CA (US)

(72) Inventors: Matthew Myers, Carlsbad, CA (US); James A. Seluga, Carlsbad, CA (US); Wee Joung Kim, Vista, CA (US)

(73) Assignee: Callaway Golf Company, Carlsbad, CA (US)

( * ) Notice: Subject to any disclaimer, the term of this patent is extended or adjusted under 35 U.S.C. 154(b) by 63 days.

(21) Appl. No.: 14/823,834

(22) Filed: Aug. 11, 2015

Related U.S. Application Data

(63) Continuation-in-part of application No. 14/216,971, filed on Mar. 17, 2014, now Pat. No. 9,387,376.

(60) Provisional application No. 61/940,288, filed on Feb. 14, 2014.

(51) Int. Cl.
*A63B 53/04* (2015.01)
*A63B 53/06* (2015.01)

(52) U.S. Cl.
CPC ..... *A63B 53/06* (2013.01); *A63B 53/047* (2013.01); *A63B 53/0466* (2013.01); *A63B 2053/0491* (2013.01)

(58) Field of Classification Search
USPC ..... 473/324–350
See application file for complete search history.

(56) References Cited

U.S. PATENT DOCUMENTS 7,611,424 B2 * 11/2009 Nagai ..... A63B 53/0466 473/334
7,775,905 B2 * 8/2010 Beach ..... A63B 53/0466 473/256
8,016,694 B2 * 9/2011 Llewellyn ..... A63B 53/0466 473/334
8,192,303 B2 * 6/2012 Ban ..... A63B 53/0466 473/335
8,202,175 B2 * 6/2012 Ban ..... A63B 53/0466 473/334
8,696,491 B1 * 4/2014 Myers ..... A63B 53/06 473/334
8,784,232 B2 * 7/2014 Jertson ..... A63B 53/0466 473/324
8,894,506 B1 * 11/2014 Myers ..... A63B 53/0466 473/334
8,944,934 B2 * 2/2015 Yamamoto ..... A63B 53/0466 473/334
9,211,453 B1 * 12/2015 Foster ..... A63B 53/06
(Continued)

FOREIGN PATENT DOCUMENTS

JP 2006320493 A * 11/2006

*Primary Examiner* — Alvin Hunter
(74) *Attorney, Agent, or Firm* — Rebecca Hanovice; Michael Catania; Sonia Lari

(57) ABSTRACT

A golf club head comprising at least one weight port and a cam weight sized to reversibly lock into the weight port is disclosed herein. The weight port includes a floor, a wall, a first seating tab extending from the wall, and a second seating tab extending from the wall, but no openings communicating with an interior of the golf club head. The cam weight, which preferably is composed of a single material, includes a cylindrical body, a first helical wing, a second helical wing, and a tool engagement feature. The helical wings give the cam weight a keyed shape, which matches the shape of the weight port when the seating tabs are taken into account.

20 Claims, 6 Drawing Sheets

(56) References Cited

U.S. PATENT DOCUMENTS

| | | | | |
|---|---|---|---|---|
| 9,238,162 | B2 * | 1/2016 | Breier | A63B 53/0466 |
| 9,289,660 | B1 * | 3/2016 | Myers | A63B 53/06 |
| 2006/0122004 | A1 * | 6/2006 | Chen | A63B 53/0466<br>473/335 |
| 2006/0172821 | A1 * | 8/2006 | Evans | A63B 53/0466<br>473/349 |
| 2006/0240908 | A1 * | 10/2006 | Adams | A63B 53/0466<br>473/334 |
| 2008/0261715 | A1 * | 10/2008 | Carter | A63B 53/0466<br>473/291 |
| 2014/0113742 | A1 | 4/2014 | Zimmerman et al. | |

* cited by examiner

GOLF CLUB HEAD WITH CAM WEIGHT

CROSS REFERENCES TO RELATED APPLICATIONS

The present application is a continuation-in-part of U.S. patent application Ser. No. 14/216,971, filed on Mar. 17, 2014, which claims priority to 61/940,288, filed on Feb. 14, 2014, the disclosure of each of which is hereby incorporated by reference in its entirety herein.

STATEMENT REGARDING FEDERALLY SPONSORED RESEARCH OR DEVELOPMENT

Not Applicable

BACKGROUND OF THE INVENTION

Field of the Invention

The present invention relates to a weight feature for use with sporting goods such as golf clubs. More specifically, the present invention relates to a cam weight for a golf club head that has a lockable, interference fit structure.

Description of the Related Art

The ability to adjust center of gravity location and weight in the head of driving clubs is useful for controlling performance of the golf club. The prior art includes several different solutions for adjustable weighting, including removable weight screws, which were provided with the Callaway RAZR Fit driver, for example. Other prior art weight screw configurations are disclosed in U.S. Pat. Nos. 6,773,360, and 7,452,285. While these weighting solutions are easy to use, they are not ideal because they include through-holes that extend into the interior of the golf club heads and must be covered when not in use to conform to USGA regulations. Similarly, the weight plugs disclosed in U.S. Pat. No. 7,744,484 require covers, which add weight that could be used elsewhere in the club head to optimize center of gravity (CG) and moment of inertia (MOI). Therefore, there is a need for a weighting mechanism that allows for simple and flexible CG and MOI optimization and adjustability.

BRIEF SUMMARY OF THE INVENTION

The present invention is a novel way of working with adjustable products. The present invention allows consumers to easily move and fix a weight at set locations without requiring through bores or openings to receive fixing screws or other types of mechanical fasteners, such as covers and seals. The weights of the present invention have built in fastening features and thus are easier and more efficient to use with a golf club head.

One aspect of the present invention is a golf club head comprising a head body comprising at least one weight port having a floor, a wall, a first seating tab extending from the wall, and a second seating tab extending from the wall, and a cam weight comprising a cylindrical body, a first wing, a second wing, and a tool engagement feature, wherein the at least one weight port does not comprise any through-openings, wherein the at least one weight port is cylindrical, wherein the cam weight is sized to removably fit within the at least one weight port, wherein each of the first wing and the second wing has a tapered thickness, wherein the first wing and the second wing are spaced from one another on the cylindrical body, and wherein each of the first wing and the second wing extends only partway around the cylindrical body. In some embodiments, the head body may comprise a crown, a sole, and a face, and the at least one weight port may be in the sole. In a further embodiment, the head body may comprise a rear edge, and the weight port may be disposed proximate the rear edge. In some embodiments, the golf club head may be a driver-type head, while in other embodiments the golf club head may be an iron-type head.

In some embodiments, the golf club head may further comprise a spring element sized to fit within a counterbore in the cylindrical body of the cam weight. In other embodiments, the cam weight may be composed of a single material, which can be selected from the group consisting of steel, titanium alloy, and tungsten alloy or the group consisting of plastic, rubber, and composite. In other embodiments, the first seating tab may be located directly opposite the second seating tab in the weight port. In any of the embodiments herein, the first wing may comprise a first end with a first width and a second end with a second width that is greater than the first width. There may be vertical spacing between the first wing and the first seating tab when the cam weight is in an unlocked configuration within the weight port, and no vertical spacing between the first wing and the first seating tab when the cam weight is in a locked configuration within the weight port.

Another aspect of the present invention is a driver-type golf club head comprising a head body comprising a face, a crown, a sole, a rear edge, a first cylindrical weight port, a second cylindrical weight port, and a hollow interior, a cam weight comprising a cylindrical body, a first helical wing, a second helical wing, a tool engagement feature, and a counterbore, and a spring sized to fit within the counterbore, wherein each of the first and second cylindrical weight ports comprises a floor, a wall, a first seating tab extending from the wall, and a second seating tab extending from the wall at a location directly opposite the first seating tab, wherein neither of the cylindrical weight ports comprises any through-openings that communicate with the hollow interior, wherein the cam weight is sized to removably fit within each of the first and second cylindrical weight ports, wherein the cam weight is composed of a single material, wherein each of the first helical wing and the second helical wing has a tapered thickness, wherein the first helical wing and the second helical wing are spaced from one another on the cylindrical body, and wherein each of the first helical wing and the second helical wing extends only partway around the cylindrical body.

In some embodiments, the golf club head may comprise vertical spacing between the first helical wing and the first seating tab when the cam weight is in an unlocked configuration within one of the first and second cylindrical weight ports, and no vertical spacing between the first helical wing and the first seating tab when the cam weight is in a locked configuration within the weight port. In other embodiments, the cam weight material may be selected from the group consisting of steel, titanium alloy, and tungsten alloy. In still other embodiments, the spring may be composed of stainless steel. In some embodiments, the crown and sole may be composed of a composite material and the face may be composed of a metal material, while in alternative embodiments the crown may be composed of a composite material and the face and sole may be composed of a metal material.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
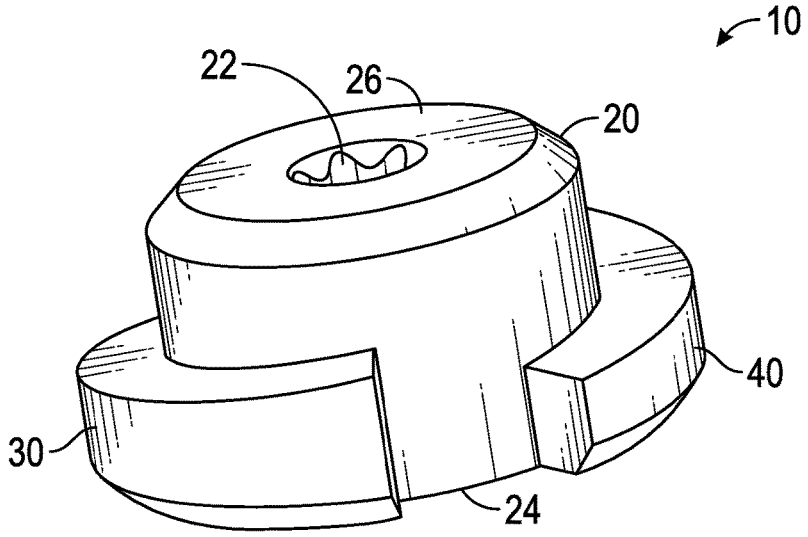
FIG. 1 is a side perspective view of a cam weight of the present invention.
Figure 2:
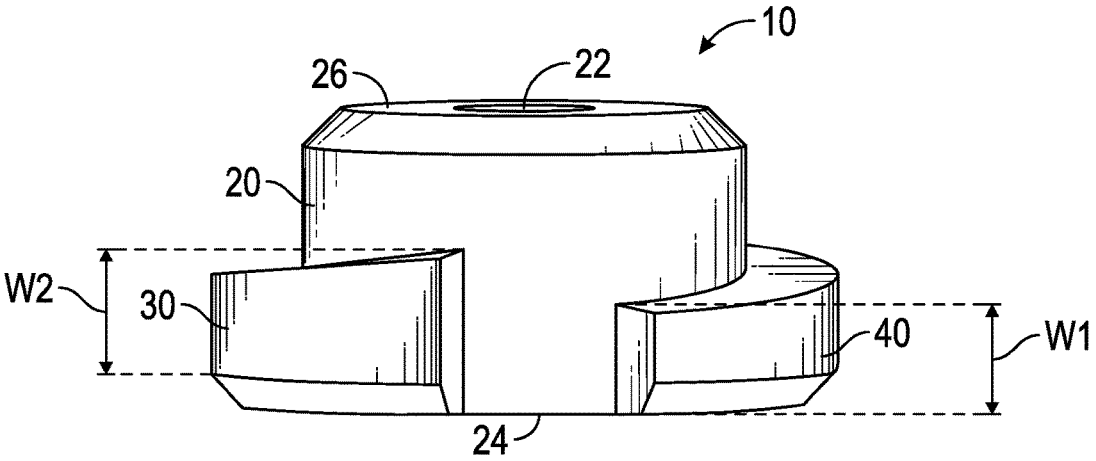
FIG. 2 is a side elevation view of the cam weight shown in FIG. 1.
Figure 3:
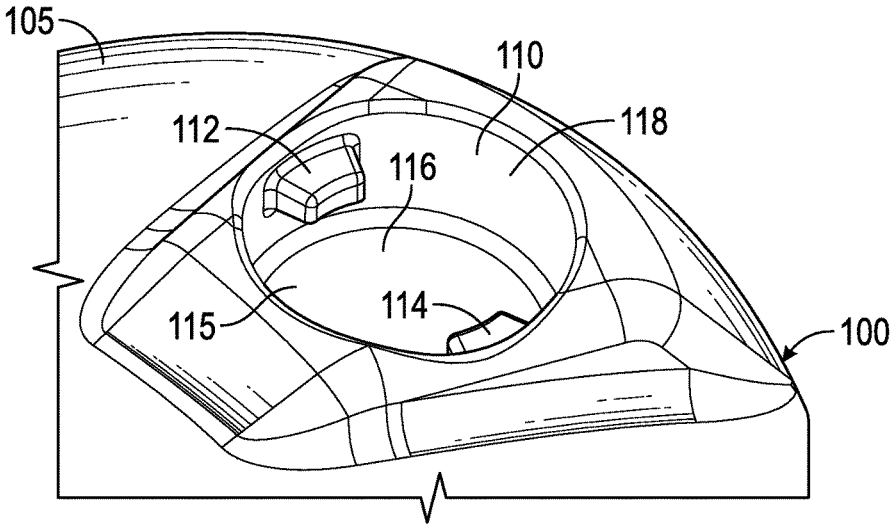
FIG. 3 is a top perspective view of a weight port of the present invention.

A first embodiment of the cam weight 10 of the present invention is shown in FIGS. 1-9. The cam weight 10 comprises a cylindrical body 20, a tool engagement portion 22, a first helical wing 30, and a second helical wing 40, each of which taper upwards from a base surface 24 of the body 20 towards an upper surface 26 of the body 20, without actually contacting the upper surface 26. The wings 30, 40 extend only part way around the body 20 and increase in width, from a smallest width $W_1$ to a greatest width $W_2$, as they do so. The wings 30, 40 give the cam weight 10 a keyed shape when viewed from above or below. The cam weight 10 has an overall height of 0.10 to 1.00 inch, and more preferably approximately 0.40 inch, and an overall diameter of 0.50 to 1.50 inch, and more preferably approximately 0.85 inch. The cylindrical body 20 has a diameter of 0.20 to 1.00 inch, and more preferably approximately 0.60 inch. The cam weight 10 also includes a counterbore 28 extending into the cylindrical body 20 from the base surface 24, the dimensions of which can be adjusted during manufacturing to ensure that the cam weight 10 has a desirable mass.

Figure 4:
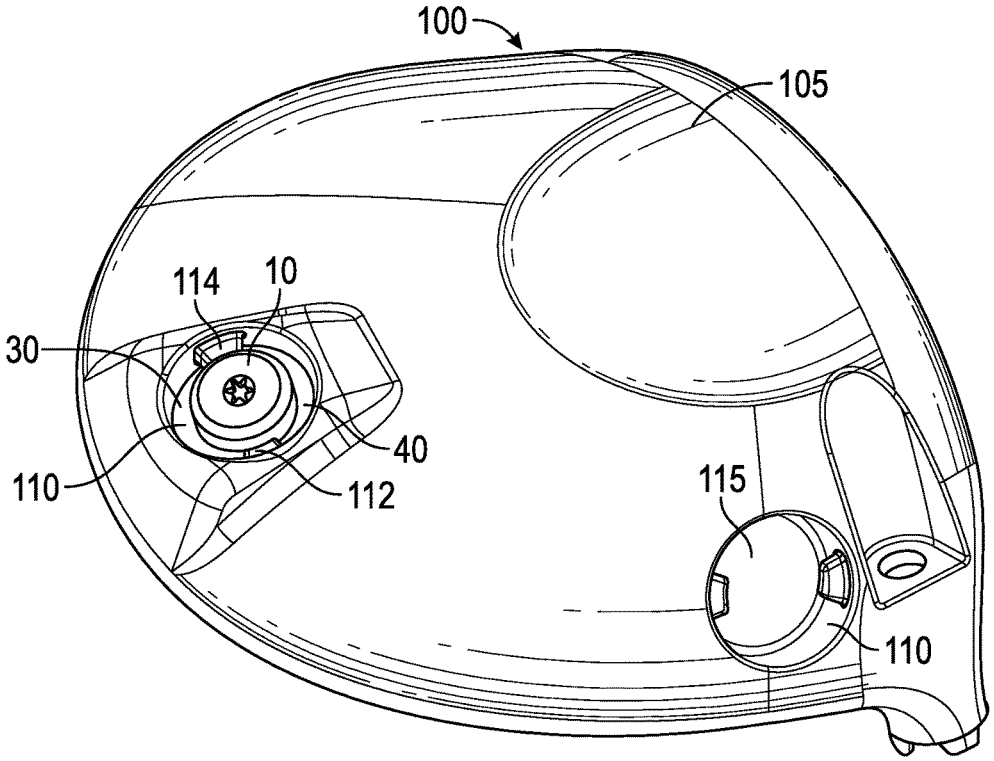
FIG. 4 is a top elevation view of the cam weight shown in FIG. 1 engaged with the weight port shown in FIG. 3.

The cam weight 10 is sized to fit within one or more weight ports 110 disposed in a golf club head 100. As shown in the Figures, the weight ports 110 preferably are located in a sole portion 105 of the head 100, though they can be located anywhere on the head 100, including in the crown, sole, skirt, face, and/or rear portion of the head 100 if it is a wood-type club, or analogous locations if it is an iron or putter-type club. As shown in FIG. 4, the golf club head 100 preferably includes at least two weight ports 110 in the sole 105, so that the cam weight 10 can be moved to change the mass properties of the head 100.

Figure 5:
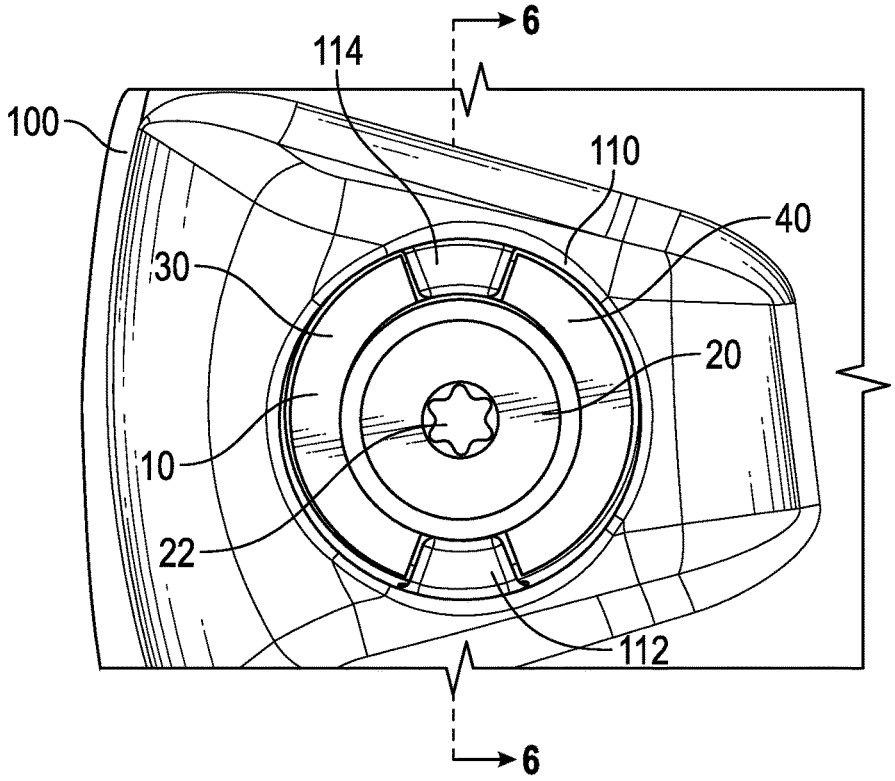
FIG. 5 is a top plan view of the cam weight shown in FIG. 1 in an unlocked configuration in the weight port shown in FIG. 3.
Figure 6:
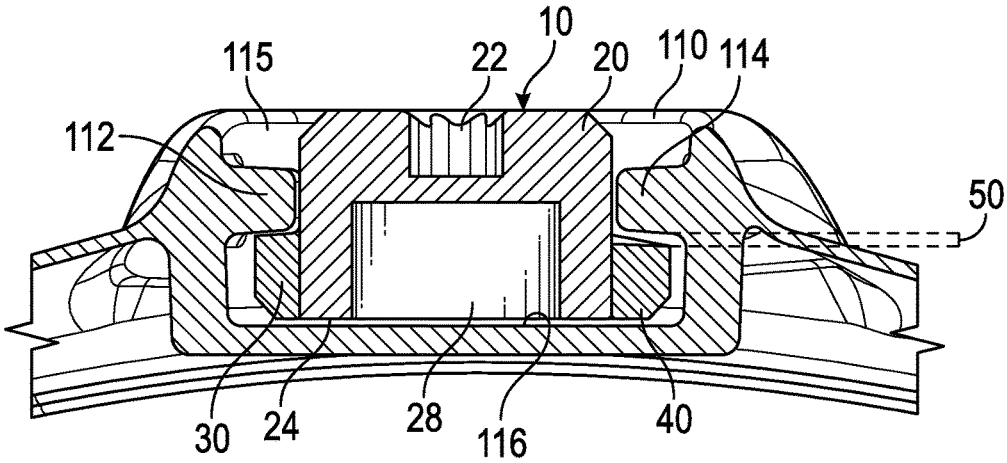
FIG. 6 is a cross-sectional view of the embodiment shown in FIG. 5 along lines 6-6.

The weight port 110 of the present invention has an opening 115 with a shape that matches the keyed shape of the cam weight 10, but does not have any through-holes, bores, or other such openings leading to an interior of the golf club head 100, which preferably is hollow and completely enclosed. The keyed shape of the weight port 110 is created by two seating tabs 112, 114 extending away from an inner wall 118 of the weight port 110. The seating tabs 112, 114 each have a maximum width of 0.10 to 0.50 inch, and more preferably of 0.26 inch, and a thickness of 0.050 to 0.150 inch, and more preferably 0.110 inch. The seating tabs 112, 114, which are located directly opposite one another in the weight port 110, extend only a short distance into the weight port 110 but require that the cam weight 10 be oriented, when inserted into the weight port 110, so that the wings 30, 40 do not overlap the seating tabs 112, 114, as shown in FIGS. 4-6. Once the base surface 24 of the cam weight 10 makes contact with the bottom surface 116 of the weight port 110, the cam weight 10 is ready to be rotated and locked into place. As shown in FIG. 6, there is vertical spacing 50 between the portions of the wings 30, 40 having the smallest width $W_1$ and the seating tabs 112, 114, which allows the cam weight 10 to be rotated. There is no vertical spacing between the portions of the wings 30, 40 with the greatest width $W_2$ and the seating tabs 112, 114, so the cam weight 10 can only be rotated in one direction.

Figure 7:
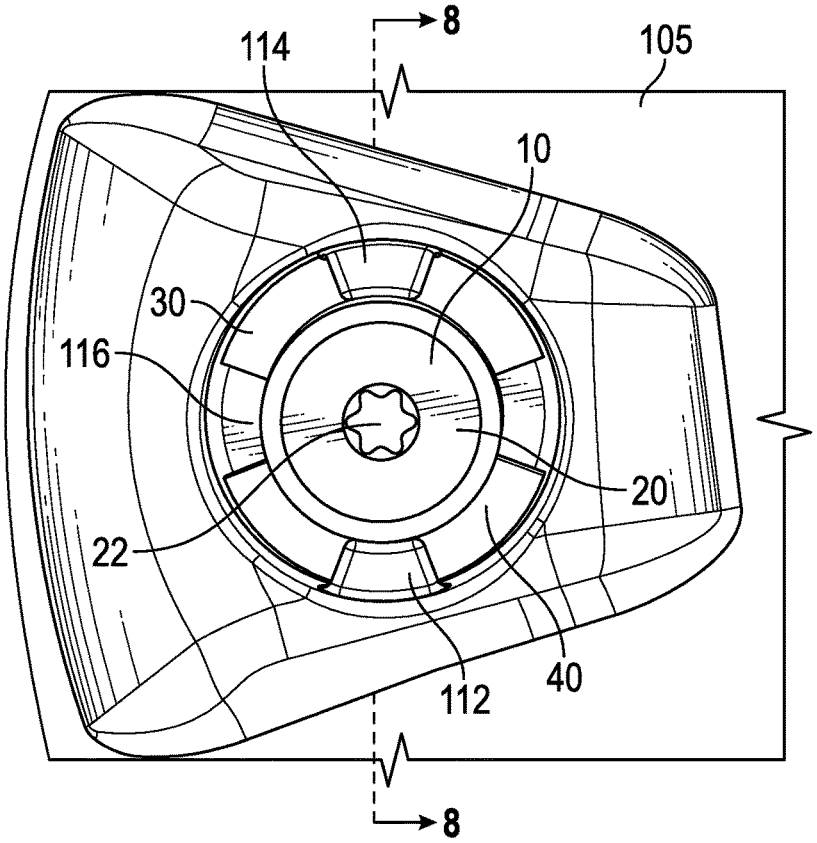
FIG. 7 is a top plan view of the cam weight shown in FIG. 1 along in a locked configuration in the weight port shown in FIG. 3.
Figure 8:
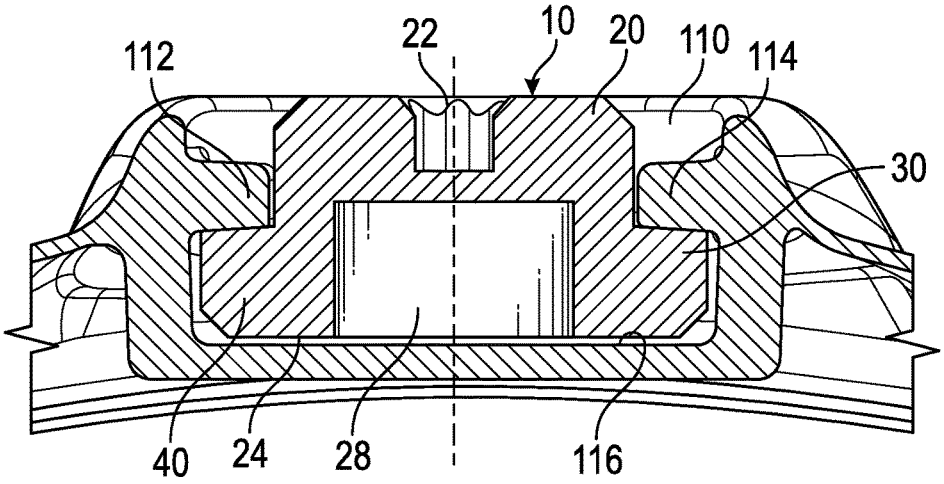
FIG. 8 is a cross-sectional view of the embodiment shown in FIG. 7 along lines 8-8.
Figure 9:
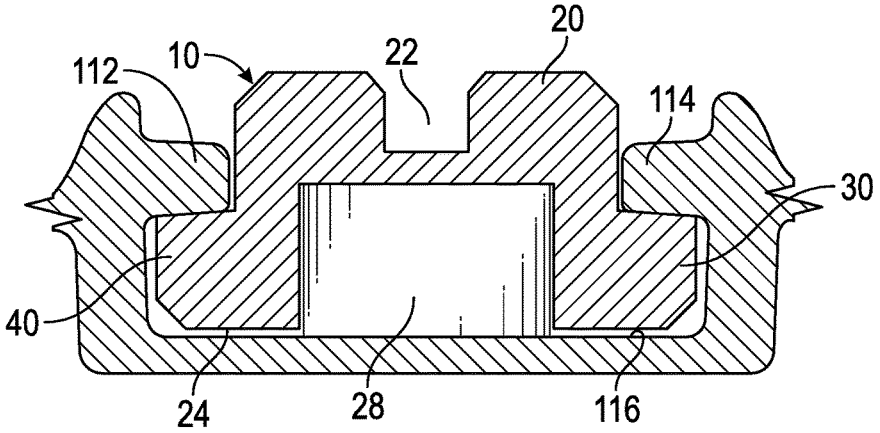
FIG. 9 is a simplified view of the cross-section shown in FIG. 8.

When the cam weight 10 is fully inserted into the weight port 110, a tool such a s a screwdriver or Torx® wrench (not shown) is inserted into the tool engagement portion 22 and used to rotate the cam weight 10 in place until the wings 30, 40 create an interference fit with the seating tabs 112, 114, as shown in FIGS. 7-8. The seating tabs 112, 114 exert downward force against the tapered wings 30, 40 when the cam weight 10 is rotated and, by doing so, push the cam weight 10 against the bottom surface 116 of the weight port 110. As shown in FIGS. 8 and 9, when the cam weight 10 is in its locked position, there is no spacing between the wings 30, 40 and the seating tabs 112, 114 as compared with the unlocked configuration (FIG. 6). The taper on the wings 30, 40 self-centers the cam weight 10 in the weight port 110, which allows for looser manufacturing tolerances in seating geometry for both the cam weight 10 and the weight port 110.

Figure 10:
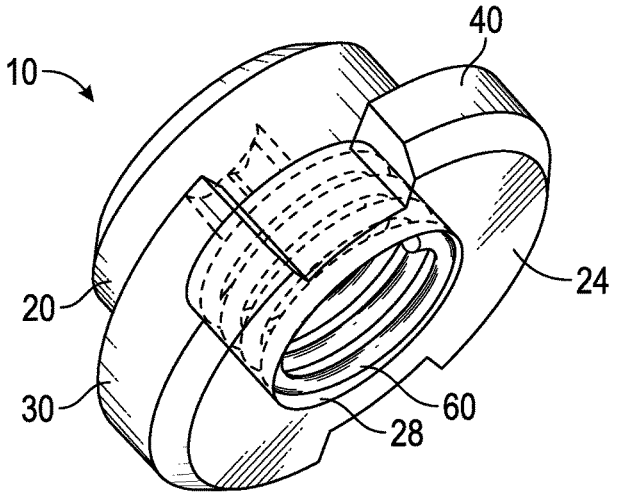
FIG. 10 is a side perspective view of another embodiment of the cam weight of the present invention.
Figure 11:
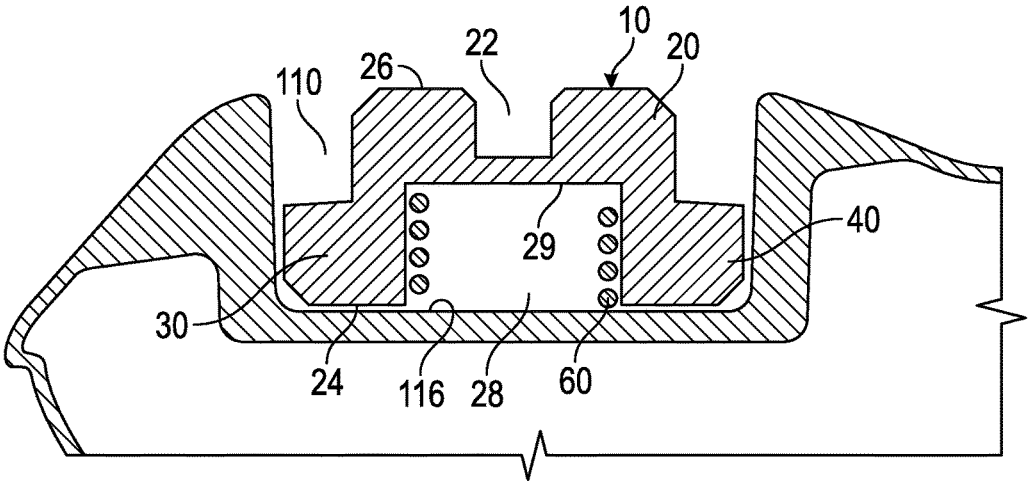
FIG. 11 is a simplified, cross-sectional view of the cam weight shown in FIG. 10 engaged with the weight port shown in FIG. 3.
Figure 12:
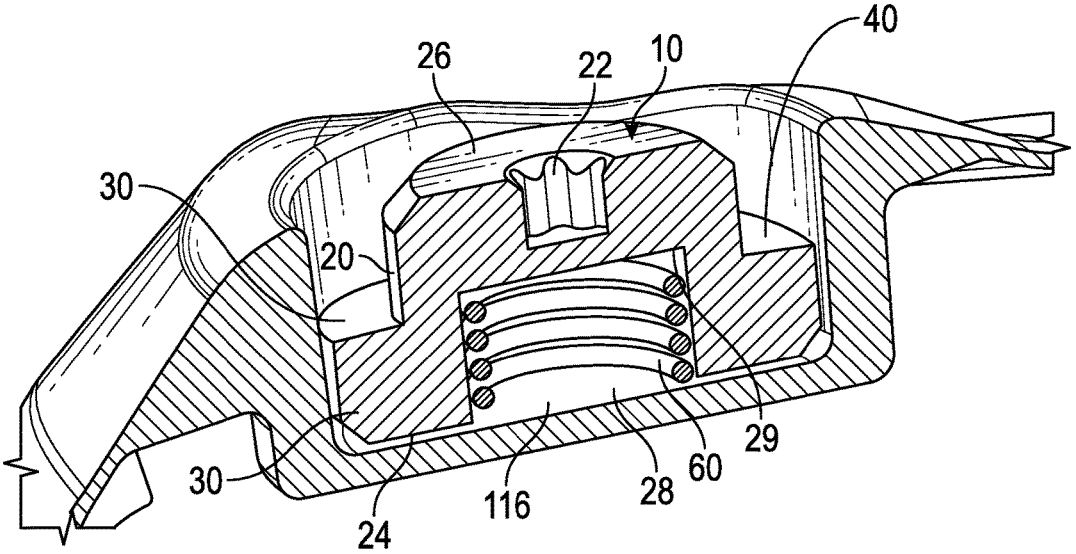
FIG. 12 is a cross-sectional view of the cam weight shown in FIG. 10 engaged with the weight port shown in FIG. 3.

In an alternative embodiment, shown in FIGS. 10-12, a spring 60 may be inserted into the counterbore 28 to provide additional resistance against the seating tabs 112, 114 and thus more securely fix the cam weight 10 in the weight port 110 when it is in its locked configuration. When the cam weight 10 is in its locked position, the spring 60 presses against an inner surface 29 of the counterbore and the bottom surface 116 of the weight port 110, thus pressing the cam weight 10 upwards against the seating tabs 112, 114.

Figure 13:
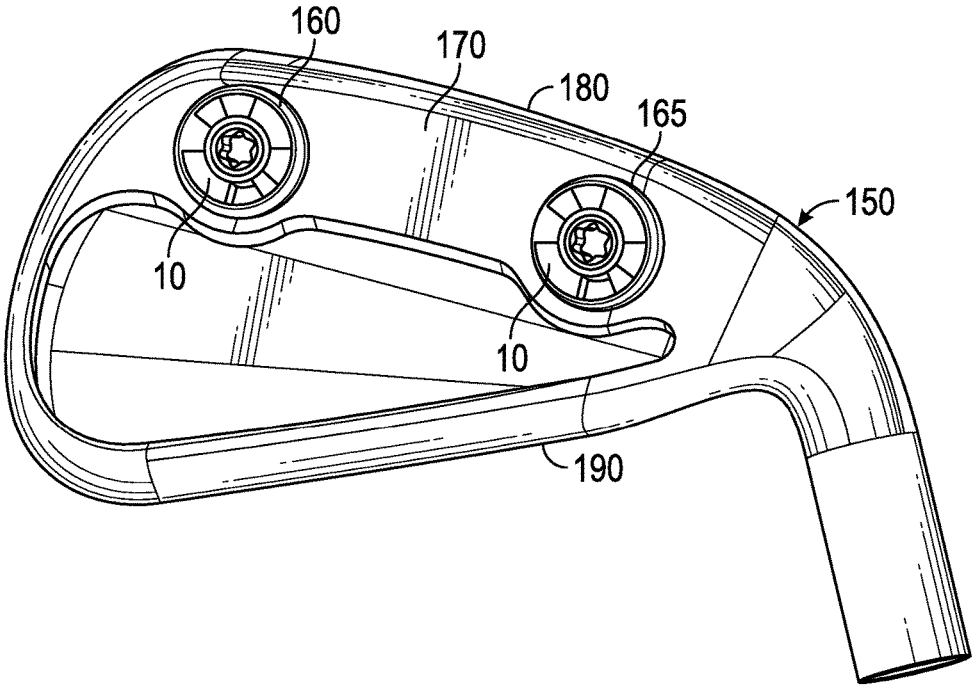
FIG. 13 is a rear elevation view of an iron-type golf club head with two cam weights of the present invention engaged with weight ports.

The design approaches described herein with reference to FIGS. 1-12 are based on a driver head characterized by a composite crown adhesively bonded to a cast titanium body. This particular construction approach permits the crown configuration to be adapted to the inventive weighting scheme with minimal impact on weight and function. However, the weighting embodiments disclosed herein can be used with other constructions, including all titanium, all composite, and a composite body with metal face cup. The cam weight 10 configurations disclosed herein can also be used in connection with other types of golf club heads, including irons, putters, and hybrids. An example of an iron head 150 comprising a pair of weight ports 160, 165 and two of the cam weights 10 disclosed herein is shown in FIG. 13. The weight ports 160, 165 are positioned in a rear flange 170 of the iron head 150, but may in alternative embodiments be positioned in one or more of the sole 180, top line 190, or any other part of the iron head 150.

In another embodiment, the weight port 110 may comprise more than two seating tabs 112, 114, and the cam weight 10 may have a matching number of wings 30, 40. In some embodiments, the golf club head 100 may have a cover feature that can be used to obscure any weight ports 110 not housing a cam weight 110, though this feature is not strictly necessary because none of the weight ports 110 of the present invention have through bores communicating with a hollow interior of the golf club head 100.

The cam weights 10 of the present invention preferably are made from a single material, and can be cast, forged, machined, extruded, molded, or made via any other process known in the art from materials including, but not limited to, as steel, titanium alloy, tungsten alloy, plastic, composite, and rubber. The spring 60 may be made of one or more of the same materials, but preferably is composed of stainless steel. In some embodiments, a golf club head 100 may be sole with multiple cam weights 10 having different material compositions and masses so that a golfer has many options for adjusting the mass properties of the golf club head 100. Though disclosed in connection with golf club heads herein, the cam weights 10 of the present invention can be used with any sporting goods equipment having weight ports.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim:

1. A golf club head comprising:

a head body comprising at least one weight port having a floor, a wall, a first seating tab extending from the wall, and a second seating tab extending from the wall; and a cam weight comprising a cylindrical body, a first wing, a second wing, and a tool engagement feature, wherein the at least one weight port does not comprise any through-openings, wherein the at least one weight port is cylindrical, wherein the cam weight is sized to removably fit within the at least one weight port, wherein each of the first wing and the second wing has a tapered thickness, wherein the first wing and the second wing are spaced from one another on the cylindrical body, and wherein each of the first wing and the second wing extends only partway around the cylindrical body.

2. The golf club head of claim 1, wherein the head body comprises a crown, a sole, and a face, and wherein the at least one weight port is disposed in the sole.

3. The golf club head of claim 2, wherein the head body comprises a rear edge, and wherein the weight port is disposed proximate the rear edge.

4. The golf club head of claim 2, wherein the golf club head is a driver-type head.

5. The golf club head of claim 1, wherein the golf club head is an iron-type head.

6. The golf club head of claim 1, further comprising a spring element, wherein the cylindrical body comprises a counterbore, and wherein the spring element is sized to at least partially fit within the counterbore.

7. The golf club head of claim 1, wherein the cam weight is composed of a single material.

8. The golf club head of claim 7, wherein the material is selected from the group consisting of steel, titanium alloy, and tungsten alloy.

9. The golf club head of claim 7, wherein the material is selected from the group consisting of plastic, rubber, and composite.

10. The golf club head of claim 1, wherein the first seating tab is located directly opposite the second seating tab in the weight port.

11. The golf club head of claim 1, wherein the first wing comprises a first end with a first width and a second end with a second width, and wherein the second width is greater than the first width.

12. The golf club head of claim 1, further comprising vertical spacing between the first wing and the first seating tab when the cam weight is in an unlocked configuration within the weight port.

13. The golf club head of claim 1, wherein there is no vertical spacing between the first wing and the first seating tab when the cam weight is in a locked configuration within the weight port.

14. A driver-type golf club head comprising:

a head body comprising a face, a crown, a sole, a rear edge, a first cylindrical weight port, a second cylindrical weight port, and a hollow interior;

a cam weight a cylindrical body, a first helical wing, a second helical wing, a tool engagement feature, and a counterbore; and a spring sized to fit within the counterbore, wherein each of the first and second cylindrical weight ports comprises a floor, a wall, a first seating tab extending from the wall, and a second seating tab extending from the wall at a location directly opposite the first seating tab, wherein neither of the cylindrical weight ports comprises any through-openings that communicate with the hollow interior, wherein the cam weight is sized to removably fit within each of the first and second cylindrical weight ports, wherein the cam weight is composed of a single material, wherein each of the first helical wing and the second helical wing has a tapered thickness, wherein the first helical wing and the second helical wing are spaced from one another on the cylindrical body, and wherein each of the first helical wing and the second helical wing extends only partway around the cylindrical body.

15. The driver-type golf club head of claim 14, further comprising vertical spacing between the first helical wing and the first seating tab when the cam weight is in an unlocked configuration within one of the first and second cylindrical weight ports.

16. The driver-type golf club head of claim 14, wherein there is no vertical spacing between the first helical wing and the first seating tab when the cam weight is in a locked configuration within the weight port.

17. The driver-type golf club head of claim 14, wherein the material is selected from the group consisting of steel, titanium alloy, and tungsten alloy.

18. The driver-type golf club head of claim 14, wherein the spring is composed of stainless steel.

19. The driver-type golf club head of claim 14, wherein the crown and sole are composed of a composite material and wherein the face is composed of a metal material.

20. The driver-type golf club head of claim 14, wherein the crown is composed of a composite material and wherein the face and sole are composed of a metal material.

* * * * *